US006152699A

United States Patent [19]

Shikata et al.

[11] Patent Number: 6,152,699

[45] Date of Patent: Nov. 28, 2000

[54] COOLING APPARATUS FOR ELECTRICAL EQUIPMENT

[75] Inventors: Kunio Shikata, Minoo; Kunio Karino, Suita; Toshikatsu Okada, Takatsuki, all of Japan

[73] Assignee: Sansha Electric Manufacturing Company, Limited, Osaka, Japan

[21] Appl. No.: 08/980,938

[22] Filed: Dec. 1, 1997

[30] Foreign Application Priority Data

Dec. 2, 1996 [JP] Japan ..... 8-337589

[51] Int. Cl.[7] ..... F04B 49/00

[52] U.S. Cl. ..... 417/12; 417/326; 417/423.1

[58] Field of Search ..... 417/12, 326, 423.1

[56] References Cited

U.S. PATENT DOCUMENTS

| | | | |
|---|---|---|---|
| 4,742,430 | 5/1988 | Sawato et al. . | |
| 5,001,463 | 3/1991 | Hamburger | 340/627 |
| 5,750,971 | 5/1998 | Taylor | 219/769 |

FOREIGN PATENT DOCUMENTS

0420650A2 4/1991 European Pat. Off. .

OTHER PUBLICATIONS

Derwent Abstract Accession No. 94–187497/23, and JP 6–125187, Hitachi Ltd.

*Primary Examiner*—Timothy S. Thorpe
*Assistant Examiner*—Cheryl J. Tyler
*Attorney, Agent, or Firm*—Duane, Morris & Heckscher LLP

[57] ABSTRACT

A cooling apparatus for electrical equipment having heat-generating components, air-intake apertures and air-outlet apertures includes a fan, a forward-rotation power control circuit, a reverse-rotation power control circuit, an indicator, a long-term timer and a short-term timer. The forward-rotation power control circuit rotates the fan in a forward direction such that air flows in through the air-intake apertures, over the heat-generating components and away through the air-outlet apertures, in response to a forward-rotation command signal. The reverse-rotation power control circuit rotates the fan in the opposite direction. The long-term timer continuously applies the forward-rotation command signal to the forward-rotation power control circuit during a first predetermined period. The indicator indicates the expiration of the first predetermined period. When the indicator is reset, the short-term timer is enabled to continuously apply the reverse-rotation command signal to the reverse-rotation power control circuit during a second predetermined period shorter than the first predetermined period.

2 Claims, 4 Drawing Sheets

COOLING APPARATUS FOR ELECTRICAL EQUIPMENT

This application is based on Japanese Patent Application No. HEI 8-337589 filed on Dec. 2, 1996 which is incorporated herein by reference.

This invention relates to an apparatus for cooling a heat-generating component in electrical equipment.

BACKGROUND OF THE INVENTION

Electrical equipment having a heat-generating component includes various apparatuses, such as arc welders, arc cutters, electrical chargers, and power supply apparatuses for communications devices and plating devices. Such electrical equipment is provided with a fan for cooling the heat-generating component. One example of the power supply apparatuses having a fan is shown in Australian Patent No. 674,633 issued on Apr. 22, 1997 (corresponding to U.S. patent application No. 08/554,529 filed on Nov. 7, 1995).

The power supply apparatus disclosed in the Australian patent has a housing in which a power supply circuit for converting AC power to DC power is disposed. The housing has a front panel formed with a plurality of air-intake apertures and a rear panel formed with a plurality of air-outlet apertures. A fan is also disposed in the housing. The fan is driven to draw air into the housing through the air-intake apertures. The air flows over heat-generating components, such as a transformer, a smoothing reactor, and a heat-dissipating fin on which semiconductor switching components are mounted, and cools them. Then, the air is driven to flow out of the housing through the air-outlet apertures.

The fan is driven during the operation of the power supply apparatus. Therefore, when the power supply apparatus is used for a long time, e.g. several months, dust may be deposited around the air-intake apertures. Such dust reduces the amount of air drawn into the housing, and thus prevents the heat-generating components from being efficiently cooled. Insufficient cooling of the components may result in failure of the power supply circuit. This problem may be raised not only in DC power supply apparatus but also any electrical equipment in which air is drawn in through an air-intake aperture for cooling. A cooling apparatus according to the present invention is used for solving the above-stated problem.

SUMMARY OF THE INVENTION

According to the present invention, a cooling apparatus for electrical equipment having a component which generates heat during operation is provided with a fan for cooling the heat-generating component, and means for driving the fan. The fan driving means, in response to a forward-rotation command signal, rotates the fan in a forward direction such that air is drawn in through an air-intake aperture and flows over the heat-generating component. Then, the air is driven out through an air-outlet aperture. The fan driving means, in response to a reverse-rotation command signal, rotates the fan in the opposite direction or in a reverse direction such that air is drawn in through the air-outlet aperture and driven out through the air-intake aperture. In addition, the cooling apparatus of the present invention includes first and second timer means. The first timer means continuously applies the forward-rotation command signal to the fan driving means during a first predetermined period. The second timer means is enabled at a time point which is determined in relation to the expiration of the first predetermined period, and continuously applies the reverse-rotation command signal to the fan driving means during a second predetermined period which is shorter than the first predetermined period.

When the cooling apparatus causes air to flow in the forward direction, dust may gather to narrow or clog the air-intake aperture. According to the present invention, however, the dust can be blown off by rotating the fan in the reverse direction, which makes air flow out through the air-intake aperture. This ensures subsequent proper cooling of the heat-generating component.

The second timer means may enable the first timer means after the second predetermined period expires.

Use of such second timer means permits the first timer means to be automatically enabled after the second predetermined period. This can eliminate the need for manual re-enabling of the first timer means. The first timer means is enabled by the second timer means, and, after expiration of the first predetermined period, dust in the air-intake aperture is blown off.

The cooling apparatus of the present invention may further include indicator means for indicating the expiration of the first predetermined period and enabling the second timer means in response to an indicator reset signal.

The fan can be rotated in the reverse direction upon the expiration of the first predetermined period for removing dust. It is, however, undesirable to reverse the fan immediately after the expiration of the first predetermined period because the dust blown from the air-intake aperture may be scattered around the power supply apparatus and choke people in the neighborhood thereof. The aforementioned indicator means is used so that a user of the power supply apparatus can know when dust should be removed from the air-intake aperture and also can remove dust at any appropriate time after the expiration of the first predetermined period, by applying the indicator reset signal. Thus, dust is not suddenly blown from the air-intake aperture.

The indicator means may provide the forward-rotation command signal, while the indicator means is indicating the expiration of the first predetermined period.

The first timer means stops applying the forward-rotation command signal to the fan driving means upon the expiration of the first predetermined period, so that the heat-generating component is left uncooled until the second timer means is enabled in response to the indicator reset signal for rotating the fan in the reverse direction. When the heat generating component remains uncooled for a long time, the electrical equipment may fail to operate properly. In order to avoid it, the indicator means may be so formed as to provide the forward-rotation command signal when enabled in response to the expiration of the first predetermined period.

When the indicator means is arranged to provide the forward-rotation command signal when enabled in response to the expiration of the first predetermined period, it may be arranged to stop providing the forward-rotation command signal in response to the indicator reset signal.

The forward-rotation command signal should be removed when the indicator reset signal is provided because the indicator reset signal enables the second timer means to rotate the fan in the reverse direction. Thus, to ensure proper rotation of the fan, the indicator means may be so formed as to stop providing the forward-rotation signal in response to the indicator reset signal.

The cooling apparatus of the present invention may include the second timer means which can enable the first timer means after the expiration of the second predetermined period, and the indicator means for indicating the expiration of the first predetermined period and enabling the second timer means in response to the indicator reset signal. In this cooling apparatus, the first timer means may be enabled a predetermined time after the expiration of the first predetermined period, and the second timer means may be enabled a predetermined time after the application of the indicator reset signal.

This arrangement can prevent the fan rotation from being abruptly switched between the forward direction and the reverse direction, so that the fan motor can be protected from damage which could be caused by the inertia of the motor.

DETAILED DESCRIPTION OF PREFERRED EMBODIMENTS

Figure 1:
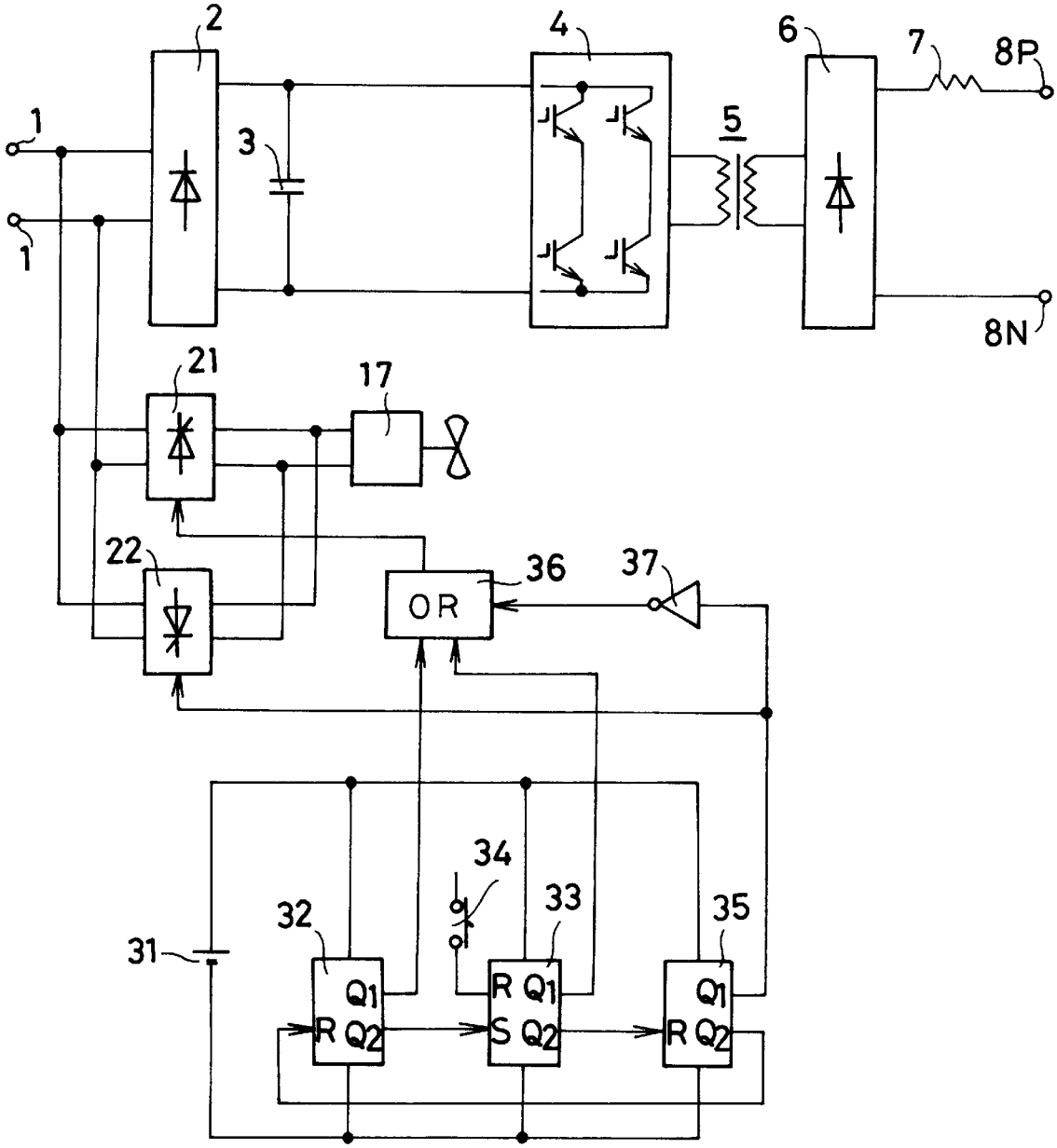
FIG. 1 is a block diagram of electrical circuitry of a cooling apparatus according to a first embodiment of the present invention used with a power supply apparatus.

As shown in FIG. 1 which illustrates a first embodiment of the present invention, a cooling apparatus of the present invention is used for a power supply apparatus. The power supply apparatus has input terminals 1, 1 to which a single-phase commercial AC power is supplied. The input terminals 1, 1 are coupled to an input rectifier circuit 2 for rectifying the commercial AC voltage. The output of the rectifier circuit 2 is smoothed by a smoothing capacitor 3 into a DC voltage. The DC voltage is applied to a high frequency inverter 4 for conversion into a high-frequency voltage. The high-frequency voltage is voltage-transformed by an isolation voltage-transformer 5. The voltage-transformed high-frequency voltage is rectified by an output rectifier circuit 6 and smoothed by a smoothing reactor 7 for application to a load (not shown) through output terminals 8P, 8N.

The rectifier circuit 2, smoothing capacitor 3, high-frequency inverter 4, voltage-transformer 5, rectifier circuit 6 and smoothing reactor 7 constitute electrical equipment referred to in the various portions of the specification, and a plurality of diodes included in the rectifier circuits 2 and 6, a plurality of semiconductor switching elements (e.g. IGBTs) included in the high-frequency inverter 4, the voltage-transformer 5 and the smoothing reactor 7 are heat-generating components referred to in the specification.

Figure 3:
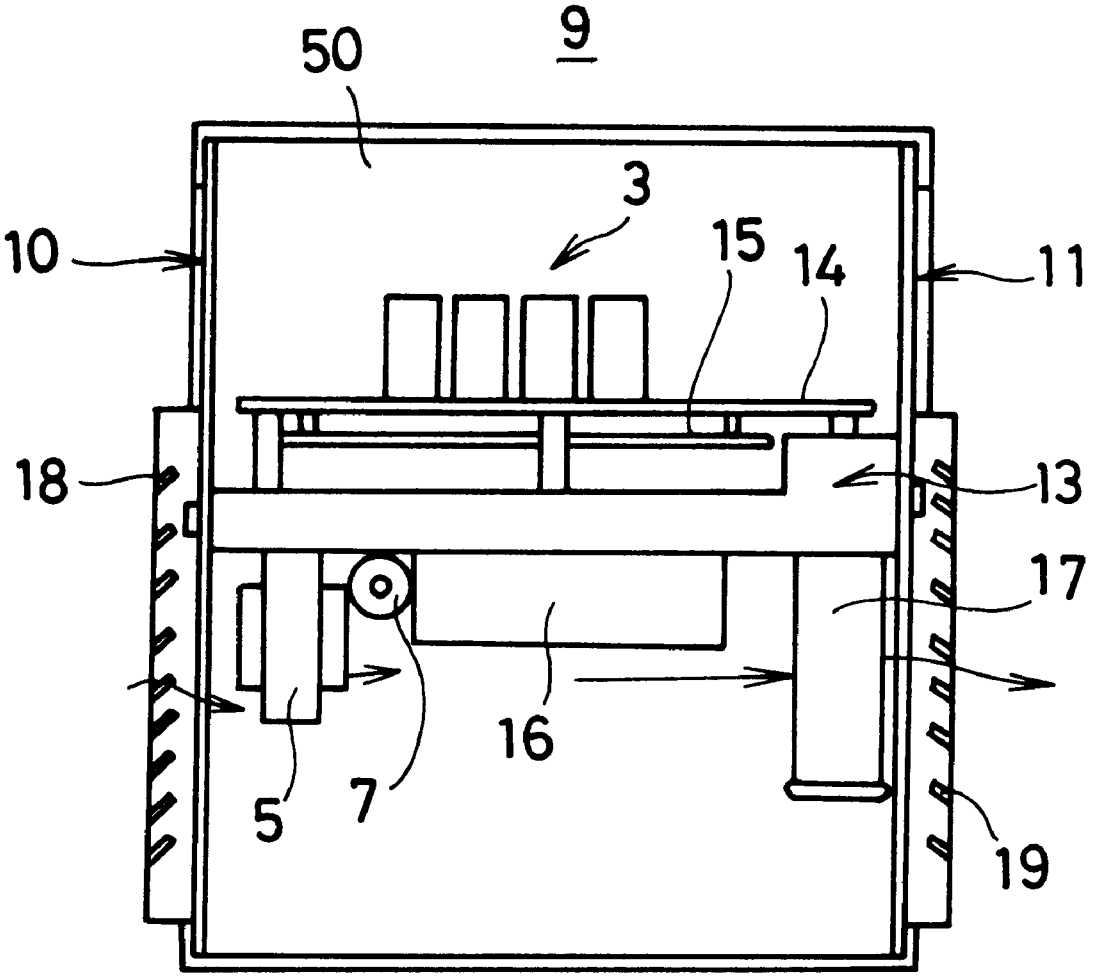
FIG. 3 a schematically cross-sectional view of the power supply apparatus with the cooling apparatus of FIG. 1.

The power supply apparatus has a housing 9 as shown in FIG. 3. The housing 9 has a front panel 10 and a rear panel 11 which are generally rectangular and are spaced from each other. Left and right panels enclose the space between the front and rear panels 10 and 11. (The left panel 50 only is shown in FIG. 3.) The housing 9 contains therein a partition 13 having its two opposed edges connected to the front and rear panels 10 and 11 at an approximately half height of the panels, thereby dividing the interior space of the housing 9 into upper and lower chambers. The partition 13 has a top surface on which a printed circuit board 14 including e.g. the smoothing capacitor 3 is mounted. A control printed circuit board 15 is disposed under the printed circuit board 14. The control printed circuit board 15 includes a circuit for controlling the high-frequency inverter 4. The control circuit is not shown in FIG. 1 for simplifying of the illustration.

In the lower chamber, the voltage-transformer 5 and the smoothing reactor 7 are attached to the partition 13 with the voltage-transformer 5 disposed nearer to the front panel 10 than the reactor 7. Heat-dissipating means or a heat sink 16 is attached to the partition 13 nearer to the rear panel 11 than the reactor 7. The heat sink 16 is disposed in a rectangular opening (not shown) in the partition 13 through which the upper and lower chambers communicate with each other. On the top surface of the heat sink 16, which is exposed in the upper chamber, components such as the semiconductor switching elements of the high-frequency inverter 4, and the diodes of the rectifier circuits 2 and 6, are mounted.

A fan 17 is attached to the partition 13 nearer to the rear panel 11 than the heat sink 16. A plurality of air-intake apertures 18 are formed in the front panel 10 and arranged vertically from a level somewhat higher than the partition 13 toward the bottom of the panel 10. Similarly, a plurality of air-outlet apertures 19 are formed in the rear panel 11 and arranged vertically from a level somewhat higher than the partition 13 toward the bottom of the panel 11.

The fan 17 is provided with e.g. a DC motor (not shown). When the DC motor is rotated in the forward direction, air is drawn into the housing 9 through the air-intake apertures 18, as represented by an arrow in FIG. 3. The air drawn flows over the voltage-transformer 5, the smoothing reactor 7, the heat sink 16, and the fan 17, and flows out through the air-outlet apertures 19. The rate of air flow through the air-intake apertures 18, however, reduces as the fan is driven to rotate in th forward direction for long time because dust increasingly gathers to clog the air-intake apertures 18.

The fan 17 can rotate in the reverse direction, so that air can be drawn into the housing 9 through the air-outlet apertures 19 and flow in the direction opposite to that indicated by the arrows in FIG. 3. The air drawn in through the air-outlet apertures 19 flows over the fan 17, the heat sink 16, the smoothing reactor 7 and the voltage-transformer 5 in the named order, and flows out through the air-intake apertures 18. The air flowing in the reverse direction can blow dust off the air-intake apertures 18.

As shown in FIG. 1, the fan 17 is coupled to a fan driving unit, or a forward-rotation power control circuit 21 and a reverse-rotation power control circuit 22. The power control circuits 21 and 22 rectify a commercial AC voltage by means of, e.g. a thyristor. The forward-rotation power control circuit 21 is responsive to a forward-rotation command signal and applies to the fan 17 a voltage of such a polarity as to rotate the fan in the forward direction. The reverse-rotation power control circuit 22 is responsive to a reverse-rotation command signal, and applies to the fan 17 a voltage of such a polarity as to rotate the fan in the reverse direction.

First timer means or a long-term timer 32 generates the forward-rotation command signal, and second timer means or a short-term timer 35 generates the reverse-rotation command signal. In addition, indicator means or an indicator 33 is provided. Each of the long-term timer 32, the short-term timer 35 and the indicator 33 has a reset terminal R and output terminals Q1 and Q2. The indicator 33 has a set terminal S, too. The timers 32 and 35 and the indicator 33 are driven by power supply means, e.g. a battery 31, separate from the commercial AC power supply. Thus, the timers 32 and 35 and the indicator 33 can be driven even when the input terminals 1, 1 do not receive a commercial AC voltage.

In place of the battery 31, a voltage obtained by separately rectifying a voltage from a commercial AC power supply may be used.

Figure 2:
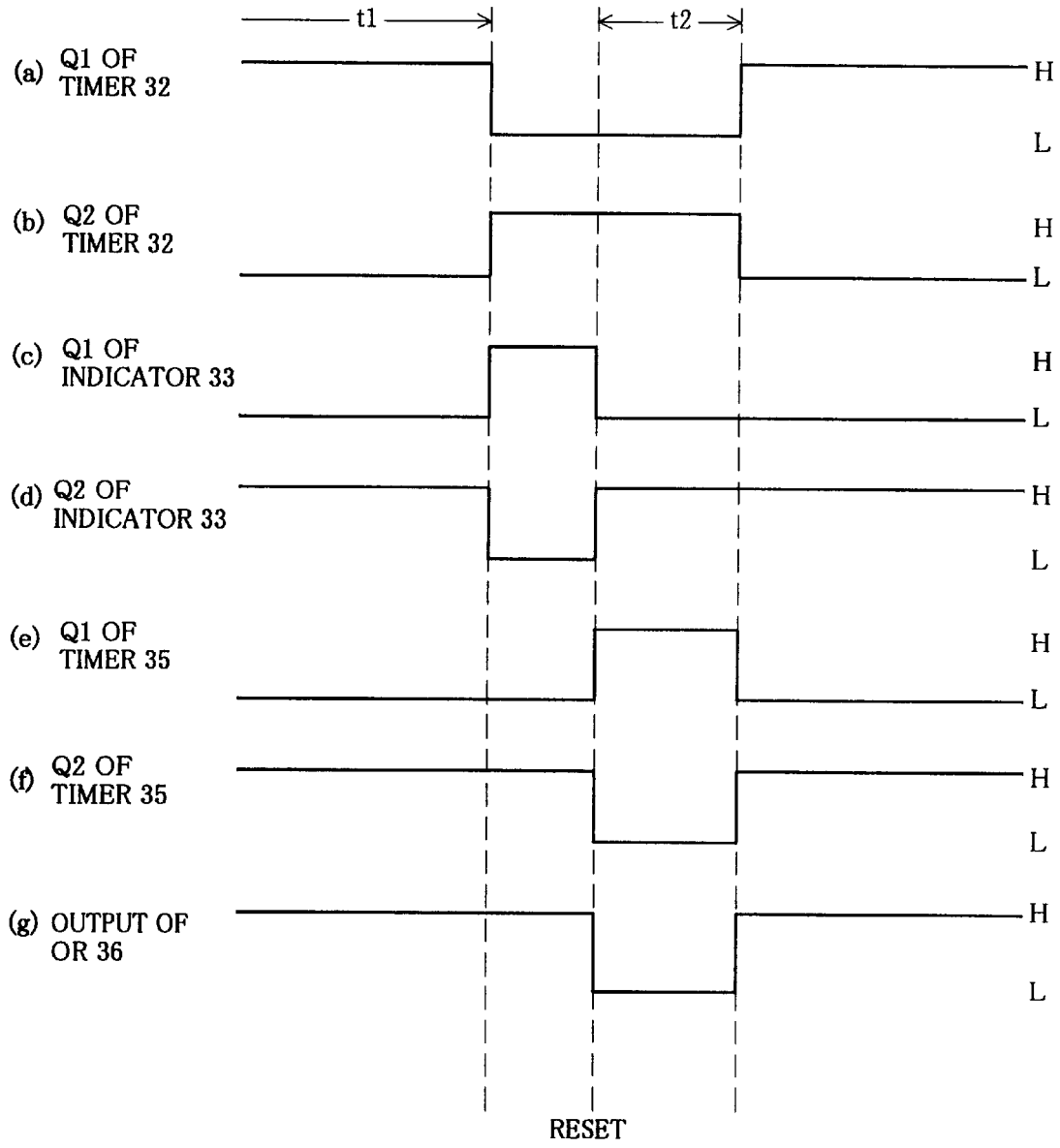
FIG. 2 shows waveforms appearing at various circuit points of the cooling apparatus of FIG. 1.

The long-term timer 32 starts counting clock signals from a clock signal source (not shown) in response to a reset signal applied to the reset terminal R of the timer 32. As shown in FIG. 2(*a*), the terminal Q1 of the timer 32 continuously provides an output at a high level (H-level) and, as shown in FIG. 2(*b*), the terminal Q2 continuously provides an output at a low level (L-level) until the count becomes a value corresponding to a first predetermined period t1. The first predetermined period t1 may be from one to six months. The H-level output at the terminal Q1 of the timer 32 is applied, as the forward-rotation command signal, through an OR circuit 36 to the forward-rotation power control circuit 21, as shown in FIG. 1. In response to this signal, the forward-rotation power control circuit 21 rotates the fan 17 in the forward direction. Thus, air flows into the housing 9 through the air-intake apertures 18 and out through the air-outlet apertures 19. The forward rotation of the fan 17 over 1–6 months may disadvantageously cause a large amount of dust to be deposited around the air-intake apertures 18.

Upon the expiration of the first predetermined period t1, the output at the terminal Q1 of the long-term timer 32 changes from H-level to L-level and the output at the terminal Q2 of the timer 32 changes from L-level to H-level. The indicator 33 is enabled in response to the H-level output applied to the set terminal S from the terminal Q2 of the timer 32, so that an indicator element, e.g. LED (not shown), of the indicator 33 is turned on to indicate the expiration of the first predetermined period t1. At the same time, the output at the terminal Q1 of the indicator 33 changes to H-level as shown in FIG. 2(*c*) and the output of the terminal Q2 changes to L-level as shown in FIG. 2(*d*). The H-level output of the terminal Q1 of the indicator 33 is applied to the forward-rotation power control circuit 21 through the OR circuit 36, so that the fan 17 continues to rotate in the forward direction.

When a user notices the expiration of the first predetermined period t1 as indicated by the indicator 33, he will operate a reset switch 34 to apply a reset signal from a reset signal source (not shown) to the terminal R of the indicator 33. It causes the LED of the indicator 33 to be turned off, causes the output of the terminal Q1 of the indicator 33 to change to L-level, and causes the output of terminal Q2 of the indicator 33 to change to H-level. The H-level output of the terminal Q2 of the indicator 33 resets the short-term timer 35, so that the timer 35 starts counting the clock signals. The terminal Q1 of the timer 35 provides a H-level output and the terminal Q2 of the timer 35 provides a L-level output. The H-level output of the terminal Q1 of the timer 35 is applied as the reverse-rotation command signal to the reverse-rotation power control circuit 22. In response to this signal, the control circuit 22 is enabled, so that the fan 17 start reverse rotation to draw air into the housing 9 through the air-outlet apertures 19 and blow air out through the air-intake apertures 18. The air flowing in the reverse direction blows off the dust in the air-intake apertures 18, and also cools the heat-generating components.

The H-level output at the terminal Q1 of the short-term timer 35 is inverted by an inverter 37 to an L-level output and then applied to the OR circuit 36. In this state, the terminals Q1 of the long-term timer 32 and the indicator 33, respectively, provide L-level outputs, but they are not applied to the forward-rotation power control circuit 21 because the OR circuit 36 is enabled to apply the outputs of the terminals Q1 of the long-term timer 32 and the indicator 33 to the forward-rotation power control circuit 21 only when the inverter 37 provides a H-level output. Thus, the forward-rotation power control circuit 21 is disabled.

The short-term timer 35, when reset, starts counting the clock signals and continues to count until a second predetermined period t2 shorter than the first predetermined period t1 expires. The second predetermined period t2 may be a period of e.g. 2–3 minutes. Upon the expiration of the second predetermined period t2, the output of the terminal Q1 of the timer 35 changes to L-level as shown in FIG. 2(*e*), so that the reverse-rotation power control circuit 22 is disabled. The L-level output of the terminal Q1 of the timer 35 is inverted by the inverter 37 to an H-level output, and then applied to the OR circuit 36, so that the OR circuit 36 is enabled.

On the expiration of the second predetermined period t2, the output at the terminal Q2 of the short-term timer 35 changes to H-level, which resets the long-term timer 32, so that the long-term timer 32 starts counting the clock signals again. The terminals Q1 and Q2 of the long-term timer 32 changes to H-level and L-level, respectively. The H-level output at the terminal Q1 of the timer 32 is applied through the OR circuit 36 to the forward-rotation power control circuit 21, to make the fan 17 start forward rotation. Then, the operation stated above is repeated.

In this embodiment, the indicator 33 is turned on upon the expiration of the first predetermined period t1 which the long-term timer 32 measures, and the short-term timer 35 is reset in response to the indicator reset signal applied to the indicator 33 through the reset switch 34 operated by a user who finds the indication. In other words, the short-term timer 35 is enabled at a time point related to the expiration of the first predetermined period t1. The fan 17 may be caused to start reverse rotation immediately upon the expiration of the first predetermined period t1 by immediately resetting the short-term timer 35 when the output of the terminal Q2 of the long-term timer 32 changes to H-level. This, however, may cause dust to be suddenly blown from the air-intake apertures 18 and scattered around the power supply apparatus. To avoid such sudden removal of dust, the fan 17 in the described embodiment does not immediately start reverse rotation even when the first predetermined period t1 has expired. Thus, people around the power supply apparatus can make preparations for preventing dust from scattering around the power supply apparatus.

A user can remove dust from the air-intake apertures 18 even before the first predetermined period t1 expires. Such removal can be effected by operating the reset switch 34 for applying the reset signal to the indicator 33. A push-button switch may be used as the switch 34. Accordingly, when an operator, who has pushed the button to close the switch 34 for application of the reset signal to the reset terminal R of the indicator 33, releases the button, the reset signal is no longer applied to the reset terminal R. Then, the output at the terminal Q2 of the indicator 33 which has changed to L-level due to the application of the reset signal to the reset terminal R returns to H-level instantly. The change of the output at the terminal Q2 from H-level to L-level and, then, to H-level resets the short-term timer 35 and enables the reverse-rotation power control circuit 22. The OR circuit 36 is disabled by a signal to which the output at the terminal Q1 of the short-term timer 35 is inverted by the inverter 37, so that the H-level output signal from the long-term timer 32 is no longer applied to the forward-rotation power control circuit 21.

The forward-rotation power control circuit 21 may be disabled upon the expiration of the first predetermined period t1. However, it is not always possible to operate the short-term timer 35 immediately after the forward-rotation power control circuit 21 stops operating. In such a case, the heat-generating components may not be cooled for a long time, which may result in failure of the power supply apparatus. To prevent such failure, the forward-rotation power control circuit 21 is maintained operable by applying the H-level output at the terminal Q1 of the indicator 33. When the short-term timer 35 is reset, the OR circuit 36 is disabled to ensure that the output at the Q1 terminal of the indicator 33 should not be applied through the OR circuit 36 to the forward-rotation power control circuit 21, so that only the reverse-rotation power control circuit 22 operates.

The long-term timer 32 is reset by the H-level output at the terminal Q2 of the short-term timer 35 which is developed when the second predetermined period t2 expires. Alternatively, the long-term timer 32 may be reset by a reset switch dedicated to the timer 32. The use of such dedicated reset switch, however, requires the determination as to whether the first predetermined period t1 has expired, in addition to the extra operation of the dedicated reset switch.

Figure 4:
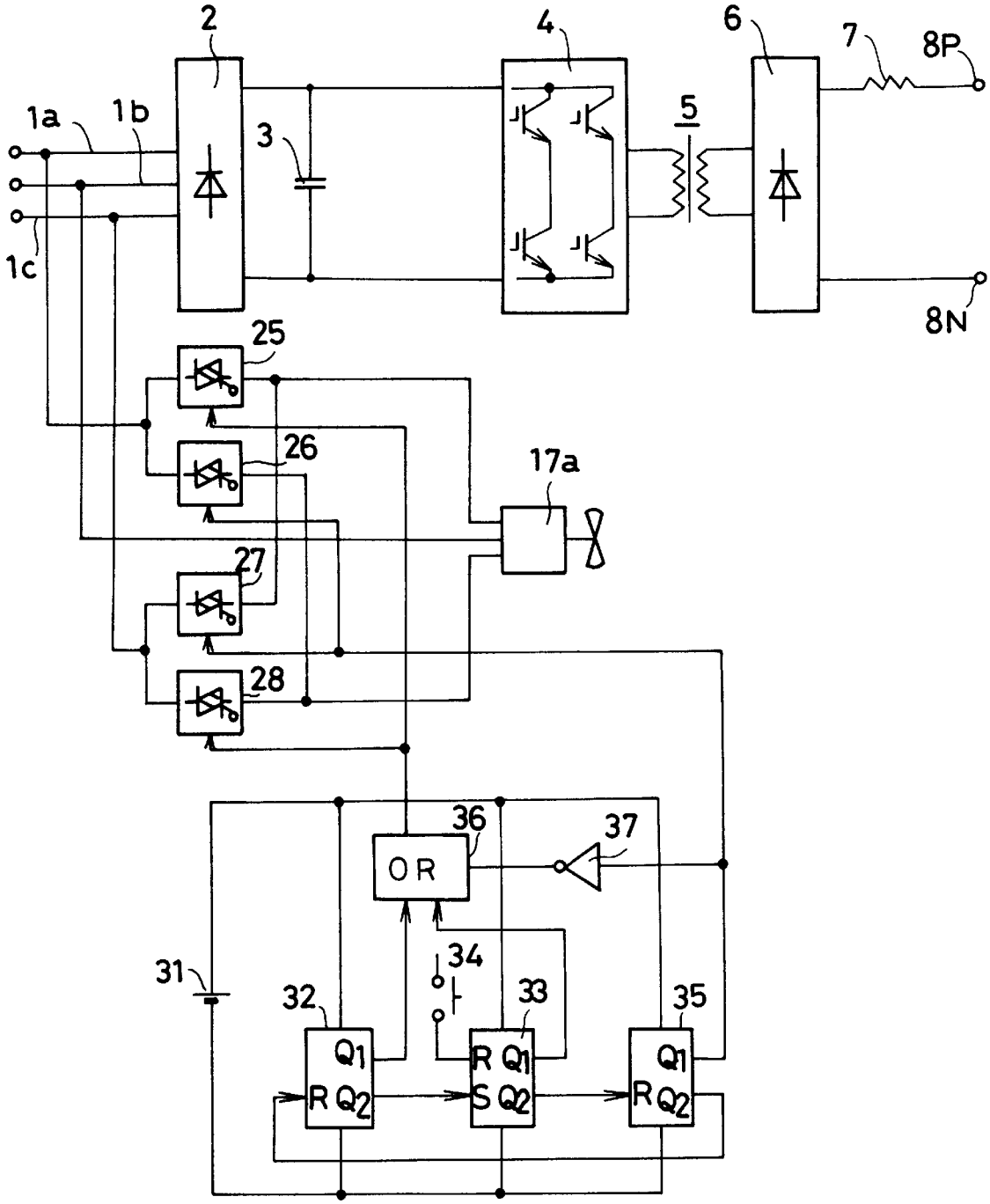
FIG. 4 is a block diagram of electrical circuitry of a cooling apparatus according to a second embodiment of the present invention used with a power supply apparatus.

FIG. 4 illustrates a second embodiment of a cooling apparatus according to the present invention used with a power supply apparatus. In the second embodiment, the power supply apparatus, having a large input capacity, is coupled to a three-phase commercial AC power supply. Because of the use of a three-phase AC power supply, the fan 17*a* is driven by a three-phase induction motor. The same reference numerals and symbols as used in FIG. 1 are used for similar components and functions of the cooling apparatus of FIG. 4, and their detailed descriptions are not given.

Phase 1*a* of the three-phase AC power supply is coupled to a first input terminal of the three-phase induction motor of the fan 17*a* through a forward-rotation power control circuit 25, and also coupled to a third input terminal of the three-phase induction motor through a reverse-rotation power control circuit 26. Phase 1*b* of the three-phase AC power supply is directly coupled to a second input terminal of the three-phase induction motor. Phase 1*c* of the three-phase AC power supply is coupled to the first input terminal of the three-phase induction motor through a reverse-rotation power control circuit 27, and also coupled to the third input terminal of the three-phase induction motor through a forward-rotation power control circuit 28. The forward-rotation power control circuits 25 and 28 and the reverse-rotation power control circuits 26 and 27, respectively, include thyristors connected in back-to-back.

The forward-rotation power control circuits 25 and 28 receive a forward-rotation command signal, and the reverse-rotation power control circuits 26 and 27 receive a reverse-rotation command signal. The forward-rotation command signal is provided from the OR circuit 36 and the reverse-rotation command signal is provided from the terminal Q1 of the short-term timer 35, in a similar way to the first embodiment.

The forward-rotation power control circuits 25 and 28 are enabled in response to the forward-rotation command signal to rotate the fan 17*a* in the forward direction. The reverse-rotation power control circuits 26 and 27 are enabled in response to the reverse-rotation command signal to rotate the fan 17*a* in the reverse direction.

In the first and second embodiments described above, the cooling apparatus of the present invention is used with power supply apparatuses. The cooling apparatus of the present invention, however, may be used with other electrical equipment having heat-generating components which are cooled by a fan.

In the described embodiments, the indicator 33 having a LED is used as indicating means. However, in place of the described indicator 33, any other devices, such as one producing sound, may be used only if they provide outputs which changes as the outputs at the Q1 and Q2 terminals of the indicator 33.

In the described embodiments, the forward rotation of the fan is changed to the reverse rotation immediately upon the reset of the short-term timer 35. For such quick reverse of the rotation, the forward-rotation power control circuit is disabled and the reverse-rotation power control circuit is enabled immediately after the short-term timer 35 is reset. Similarly, immediately after the short-term timer 35 detects the expiration of the second predetermined period t2, the reverse-rotation power control circuit is disabled and the long-term timer 32 is reset to enable the forward-rotation power control circuit.

However, in consideration of the inertia of the fan, the rotation direction is preferably changed from the forward direction to the reverse direction and vice versa, by enabling one control circuit a predetermined time after the disabling of the other control circuit. For this purpose, a delay circuit may be disposed between the terminal Q2 of the indicator 33 and the reset terminal R of the short-term timer 35, and another delay circuit may be disposed between the terminal Q2 of the short-term timer 35 and the reset terminal R of the long-term timer 32. The delay is preferably determined such that halting of the fan does not cause the temperature of the heat-generating components to exceed a predetermined value.

What is claimed is:

1. A cooling apparatus for electrical equipment having a component which generates heat when operating, said cooling apparatus comprising:

a fan for cooling said component;

a fan driving unit responsive to a forward-rotation command signal for rotating said fan in a forward direction such that air is drawn in through an air-intake aperture of the electrical equipment, flows over said component and flows out through an air-outlet aperture of the electrical equipment, said fan driving unit being also responsive to a reverse-rotation command signal for rotating said fan in a reverse direction opposite to said forward direction such that air is blown out through the air-intake aperture;

a first timer means for supplying the forward-rotation command signal to said fan driving unit during a first period and stopping providing the forward-rotation command signal in response to an expiration of said first period;

an indicator means responsive to the expiration of said first period for indicating the expiration of said first period and supplying said forward-rotation command signal to said fan driving unit, said indicator being also responsive to an indicator reset signal externally, manually applied thereto for stopping providing said forward-rotation command signal and developing a second timer enabling signal; and a second timer means for supplying the reverse-rotation command signal during a second period which starts from a time point when the second timer enabling signal is applied thereto, said second period being shorter than said first period.

2. The cooling apparatus according to claim 1 wherein said second timer means enables said first timer means after the expiration of the second period.

* * * * *